United States Patent [19]

Kirsch

[11] Patent Number: 4,484,764

[45] Date of Patent: Nov. 27, 1984

[54] FRONT BINDINGS FOR SAFETY SKI BINDINGS

[76] Inventor: Bernhard Kirsch, Im Litzelholz 23, D-5500 Trier-Biewer, Fed. Rep. of Germany

[21] Appl. No.: 384,362

[22] Filed: Jun. 2, 1982

[51] Int. Cl.[3] ..... A63C 9/08

[52] U.S. Cl. ..... 280/628; 280/618; 280/620; 280/631

[58] Field of Search ..... 280/613, 617, 618, 628, 280/629, 634, 631

[56] References Cited

U.S. PATENT DOCUMENTS

| | | | |
|---|---|---|---|
| 4,113,276 | 9/1978 | Kirsch | 280/618 |
| 4,226,439 | 10/1980 | Kirsch | 280/628 |
| 4,352,508 | 10/1982 | Spademan | 280/634 |
| 4,398,747 | 8/1983 | Bernard | 280/634 |

FOREIGN PATENT DOCUMENTS

| | | | |
|---|---|---|---|
| 2809018 | 10/1978 | Fed. Rep. of Germany | 280/618 |

*Primary Examiner*—David M. Mitchell

*Attorney, Agent, or Firm*—Ward Brown; Robert W. Beach

[57] ABSTRACT

A spindle extending transversely to the longitudinal direction of a ski and parallel to the upper surface of the ski carries sole holder elements normally engaged against a ski boot to hold the ski boot on the ski. The spindle is disposed below the plane of the ski boot sole. If the ski boot exerts force in excess of a predetermined force against the sole holder elements either longitudinally or laterally of the ski, the sole holder elements swing forward about the axis of the spindle to below the plane of the ski boot sole to permit unimpeded movement of the boot. The spindle and the sole holder elements carried thereby are mounted on the ski for movement in a direction transversely of the ski. Release mechanism automatically permits the forward swinging movement of the sole holder elements when the spindle and sole holder elements have moved transversely of the ski a predetermined distance.

13 Claims, 12 Drawing Figures

Fig.5
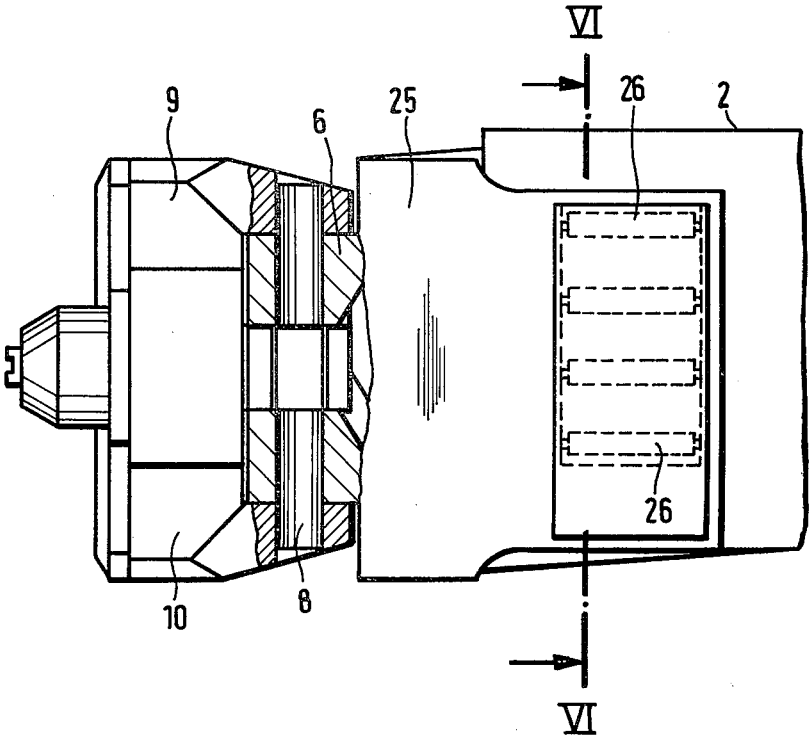
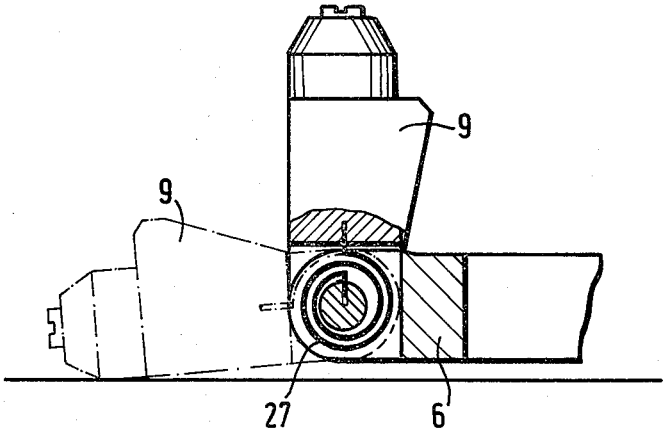
Fig.7

Fig.8
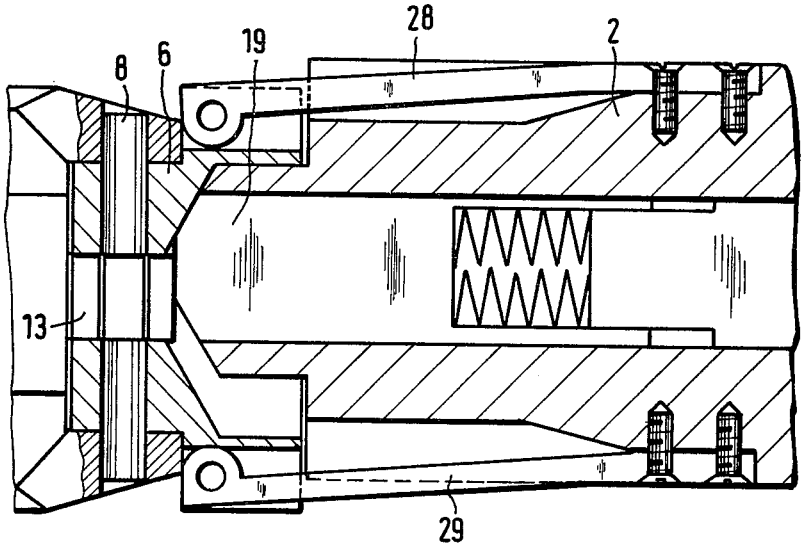
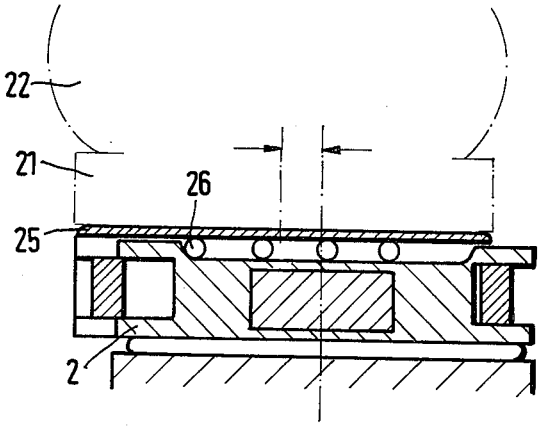
Fig.6

FRONT BINDINGS FOR SAFETY SKI BINDINGS

BACKGROUND OF THE INVENTION

1. Field of the Invention

The present invention relates to front bindings for safety ski bindings in which sole holder elements have stops normally holding a ski boot against movement longitudinally and laterally of a ski. In the case of being tripped after a preset force acting substantially in the longitudinal direction of the ski is exceeded, such elements are forwardly pivotable about a spindle extending parallel to the ski surface, transversely to the longitudinal direction of the ski and situated below the plane of the boot sole, into a release position below the plane of the ski boot sole so that the ski boot can slide forward without hindrance.

2. Prior Art

In a known front binding, a spindle carrying sole holder elements is swingable about an upright pivot extending at right angles to the ski surface. In the case of forces acting laterally of the ski, the sole holder elements swing about the upright pivot to release the ski boot. As shown by experience, the lateral tripping action is unsatisfactory in this known front binding because the toe of the ski boot must emerge laterally out of the front binding past the sole holder elements. Such known front binding can act as a stumbling block and force the skier into a forward diving fall.

SUMMARY OF THE INVENTION

It is an object of the present invention to provide a front binding of the kind hereinabove referred to in which unimpeded forward sliding of the ski boot is assured after a tripping action in the case of forces acting laterally or obliquely of the ski.

This and other objects are achieved by rotatably fitting the spindle carrying the sole holder elements in the front binding and coupling the spindle to a locking device normally preventing rotation. When a preset force acting laterally of the ski is exceeded, the locking device releases to allow rotation of the spindle with the sole holder elements in such manner that the sole holder elements are pivotable into the release position situated below the plane of the ski boot sole.

In a preferred embodiment, the sole holder elements have a spring-loaded element such as a pin, ball or the like which, in the locked position of the sole holder elements, engages in a recess of a sleeve installed rotatably on the spindle. The recess in the sleeve can be a groove extending transversely to the longitudinal direction of the ski.

The spindle, together with the sleeve and the sole holder elements, is preferably mounted on a securing member carried by a retainer secured to the ski. The securing member preferably is displaceable parallel to the ski surface and transversely to the longitudinal direction of the ski.

Close to its lateral extremities, the displaceable securing member is preferably coupled in articulated manner to corresponding ends of mutually spaced levers extending parallel to the longitudinal direction of the ski, such levers being coupled in articulated manner to the retainer at their other ends.

In another advantageous embodiment, the displaceable securing member is joined close to its lateral extremities in articulated manner to corresponding ends of mutually spaced bar or leaf springs extending parallel to the longitudinal direction of the ski, such springs being fastened to the retainer at their other ends.

The securing member and the retainer preferably have mutually cooperating stops for limiting displacement of the securing member.

Preferably a spring is provided to return the sole holder elements to their locked positions after a tripping action.

In another embodiment, a sole tread plate is connected to the securing member, the levers or the bar springs and is displaceably mounted on the retainer or the ski.

BRIEF DESCRIPTION OF THE DRAWINGS

FIG. 5 is a top plan with parts broken away showing an alternative embodiment of a front binding in accordance with the present invention, including a sole tread plate.

FIG. 6, on the drawing sheet with FIG. 8, is a section taken along the line VI—VI of FIG. 5.

FIG. 7 is a side elevation with parts broken away showing another embodiment of a front binding in accordance with the present invention.

FIG. 8 is a top plan with parts broken away showing still another embodiment of a front binding in accordance with the present invention, including bar springs.

DETAILED DESCRIPTION OF THE PREFERRED EMBODIMENTS

Figure 1:
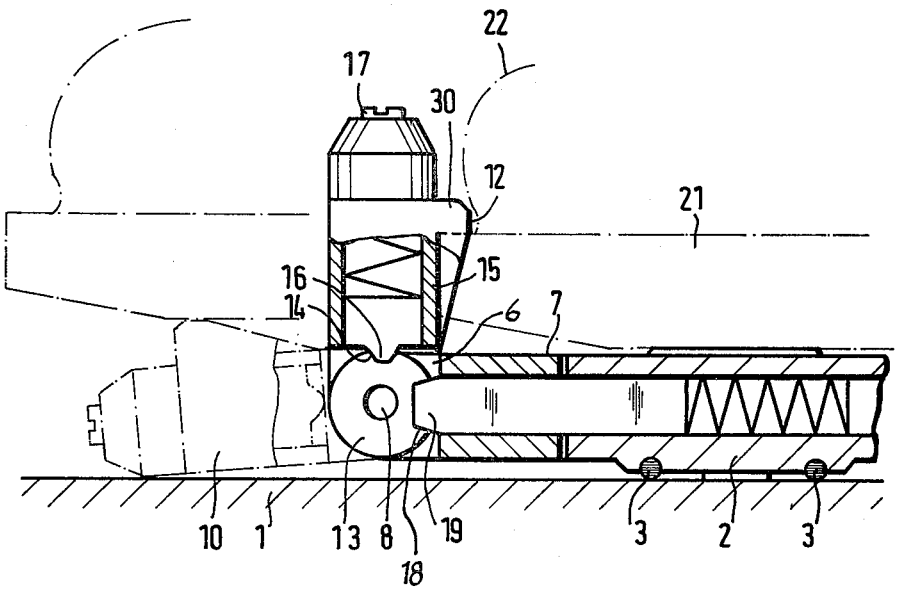
FIG. 1 is a side elevation with parts broken away showing a front binding in accordance with the present invention in the locked position, and in the release position following a frontal thrust tripping action.

Referring now to the drawings, according to FIGS. 1 through 4, a retainer 2 is secured to the upper surface of a ski 1. Resilient supports 3 for absorption of vibrations are situated between the retainer 2 and the ski 1.

Close to the lateral edges of the ski 1, parallel levers or links 4 and 5 have rear end portions pivotally connected to the retainer 2, the front end portions of such levers being pivotally connected to a securing member 6. A spindle 8 mounted in the securing member 6 extends transversely to the longitudinal direction of the ski, parallel to the ski surface and below the plane of the ski boot sole marked 7. The opposite end portions of such spindle carry sole holder elements 9 and 10 having front stops 11 normally fitted against the toe of a ski boot sole and retaining the ski boot against forward movement longitudinally of the ski. Inner upright surfaces of the sole holder elements form side stops 12 normally fitted against the opposite lateral sides of the toe of the ski boot sole for retaining the ski boot toe against movement laterally of the ski. The side stops 12 are placed on a longer lever arm from the spindle 8 than the stops 11. Furthermore, the sole holder elements 9 and 10 have top projections 30 normally engaging over the tip of the ski boot sole in the locked position. The sole holder elements 9 and 10 are joined together by means of a central member 31.

A sleeve 13 is rotatably fitted on the spindle 8. The sleeve 13 has an upper recess 14 in which a spring-loaded pin 16 is engaged. Such pin is displaceably arranged in a guide 15 of the central member 31 joining the sole holder elements 9 and 10. The spring loading may be varied by means of an adjusting screw 17.

The sleeve 13 also has a rear groove 18 extending parallel to the spindle 8, in which a spring-loaded projection 19 is engaged. Such projection is displaceably mounted in the retainer 2.

To either side beside the groove 18 of the sleeve 13 allocated to the projection 19, the securing member 6 has sliding faces 20 which are formed to widen in wedge form away from the spindle and toward the outer side of the ski.

Figure 2:
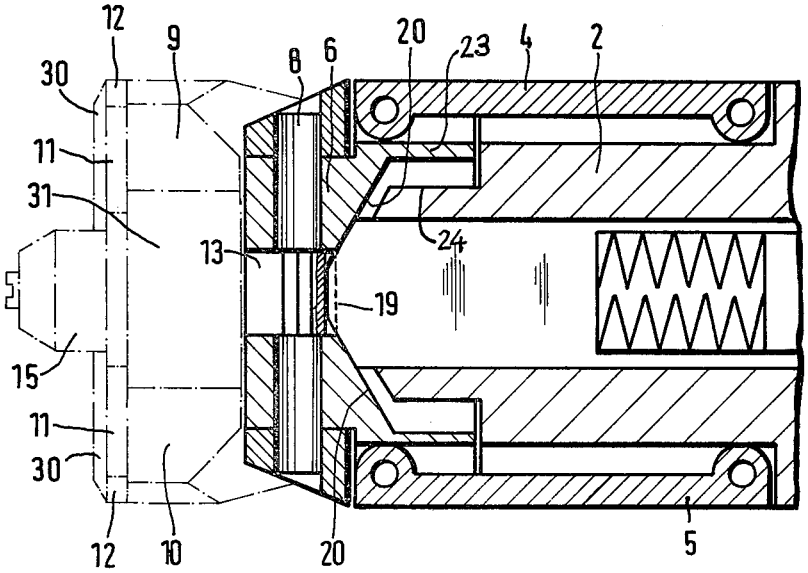
FIG. 2 is a top plan with parts broken away showing the front binding of FIG. 1 in the locked position, and in the release position following a frontal thrust tripping action.

In the position illustrated by solid lines in FIGS. 1 and 2, the front binding is in the locked position in which the pin 16 engages in the upper recess 14 of the sleeve 13 and the projection 19 engages in the rear groove 18 of the sleeve 13. The sole holder elements 9 and 10 are engaged with their stops 11 and 12 and the projections 30 over the sole 21 of a ski boot 22 inserted into the binding, and thus hold the boot in the binding.

If forces directed in the forward direction toward the tip of the ski occur, for example during frontal collision with an obstacle, the pin 16 is forced out of engagement with the recess 14 of the sleeve 13 when a preset force is exceeded, so that the sole holder elements 9 and 10 are pivoted forward into a position situated below the boot sole plane and shown dash-dotted in FIGS. 1 and 2, in which the ski boot can slide forward without hindrance. Because the spindle 8 is situated below and in front of the ski boot toe, the sole holder elements 9 and 10 initially swing upward and forward so that no jamming of the boot sole can occur.

Figure 4:
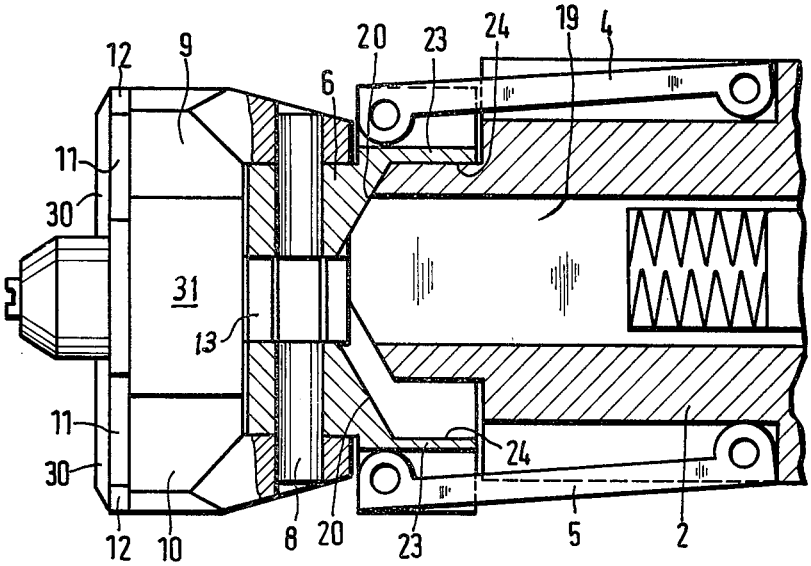
FIG. 4 is a top plan with parts broken away showing the front binding of FIG. 1 in the release position after a lateral tripping action.

In the case of forces acting sideways, i.e. transversely to the longitudinal direction of the ski, the securing member 6 is swung sideways via the levers 4 and 5 as shown in FIG. 4. Due to this lateral swinging action, the sliding faces 20 of the securing member 6 come into contact with the projection 19 and push it back so that it is taken out of engagement with the groove 18 of the sleeve 13. Consequently, the forward pivoting of the sole holder elements 9 and 10 is thereby also allowed. Stop arms 23 are provided on the securing member 6, which, together with matching stops 24 of the retainer 2 unitary with the ski, limit the sideways swinging displacement of the securing member 6.

Depending on the direction of the forces encountered, the pin 16 and/or the projection 19 will be taken out of engagement with the recesses allocated to them, thus allowing unimpeded sliding of the ski boot toward the ski tip and/or sideways. In view of the shapes of the pin 16, the projection 19 and their matching recesses, the tripping characteristic or release force of the front binding can be selected as desired. Mutually independent tripping forces can be preset for frontal and lateral tripping actions.

Figure 3:
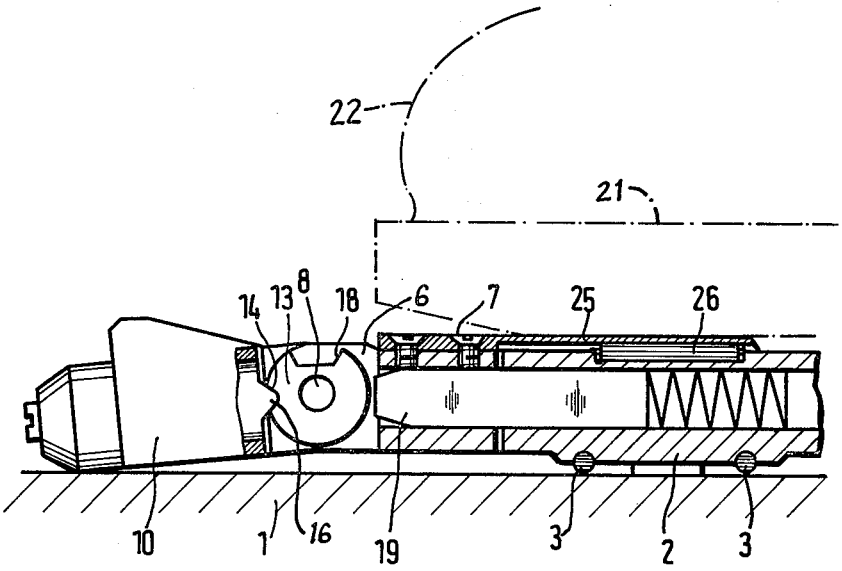
FIG. 3 is a side elevation with parts broken away showing the front binding of FIG. 1 in the release position following a lateral tripping action.
Figure 12:
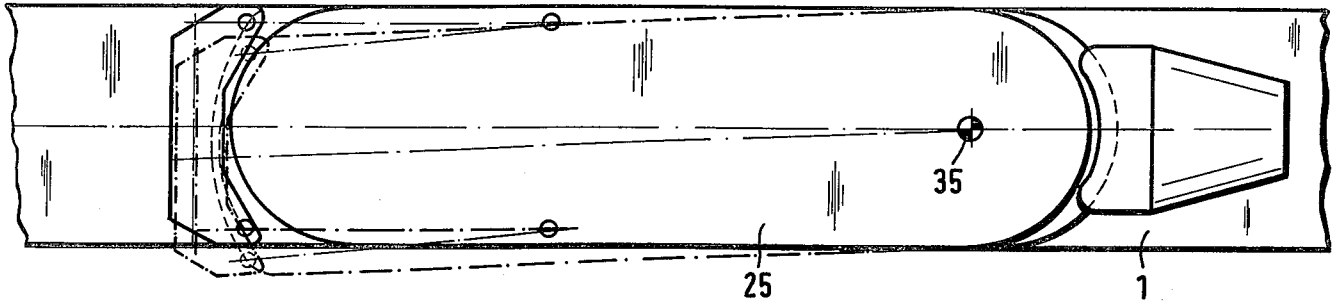
FIG. 12 is a top plan showing yet another embodiment of a front binding in accordance with the present invention, including a sole plate.

According to FIGS. 3, 5 and 12, a sole tread plate 25 is displaceably arranged on the retainer 2 unitary with the ski by means of rollers 26. During a lateral tripping action, the sole tread plate, and the ski boot placed thereon, are displaced in frictionless manner. As will also be apparent from FIG. 12, the sole tread plate 25 is pivotable around an upright spindle 35 extending at right angles to the ski surface and situated in the area of the ski boot heel.

As shown in FIG. 7, a spiral spring 27 can be provided so that, following a tripping action and after departure of the ski boot out of the binding, the sole holder elements 9 and 10 snap back automatically into the locked position. Such spring is connected between the sole holder elements 9 and 10 and the securing member 6. This is possible because only the small frictional force of the pin 16 sliding on the sleeve 13, or that of the projection 19, need be overcome to snap back the tripped sole holder elements.

In the embodiment according to FIG. 8, bar or leaf springs 28 and 29 are incorporated instead of the levers 4 and 5. Such springs are connected at their forward ends to the securing member 6 and are fastened at their rear ends to the retainer 2 unitary with the ski. These bar springs act alone or in conjunction with the spring-loaded projection 19 against lateral displacement of the securing member 6 relative to the ski.

Figure 9:
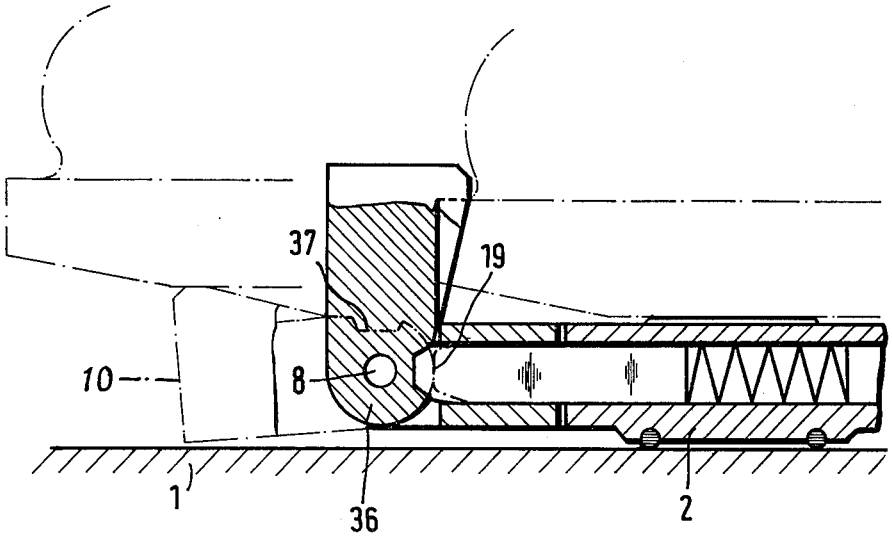
FIG. 9 is a side elevation with parts broken away showing yet another embodiment of a front binding in accordance with the present invention in the locked position.
Figure 10:
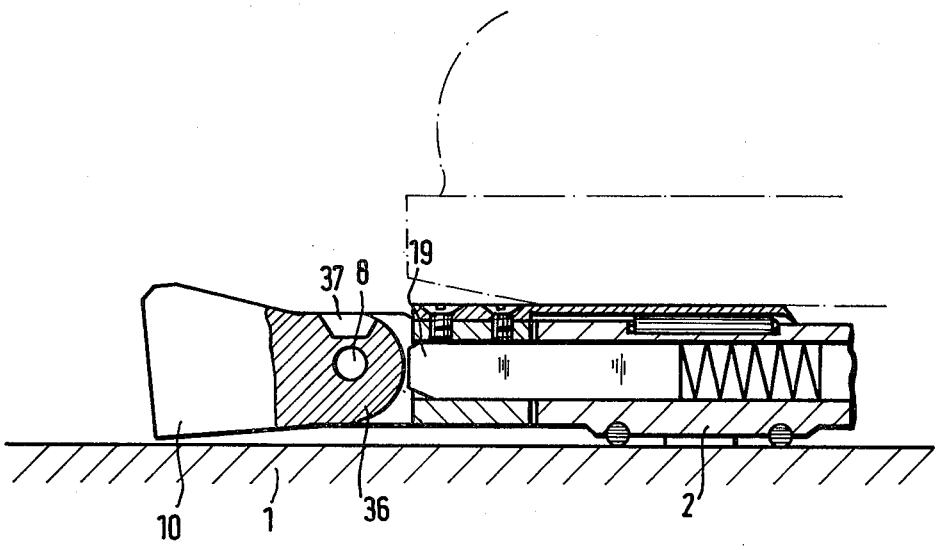
FIG. 10 is a side elevation with parts broken away showing the front binding according to FIG. 9 in the release position.
Figure 11:
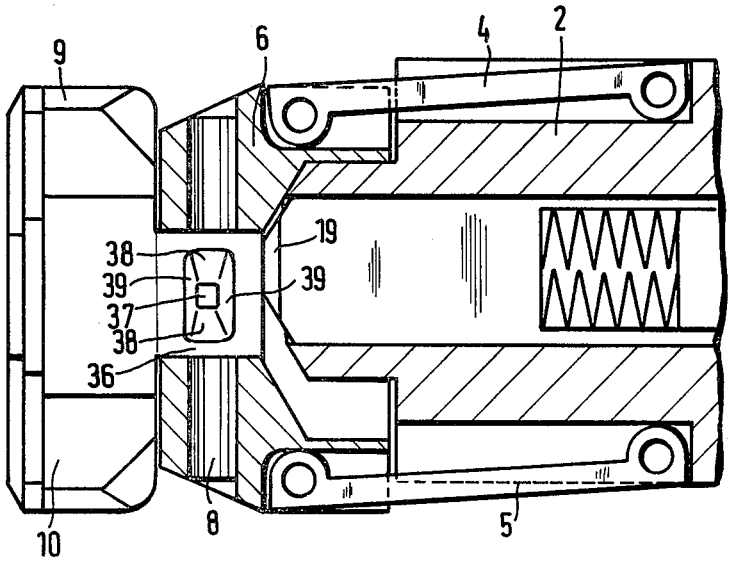
FIG. 11 is a top plan with parts broken away showing the front binding according to FIG. 9 in the release position.

In the embodiment according to FIGS. 9 through 11, the sole holder elements 9 and 10 are connected to a sleeve-like central member 36 which is rotatably arranged on the spindle 8 and has an ovally shaped depression 37 in which the projection 19 engages in the locked position. As seen in FIG. 11, the depression 37 has opposite side faces 38 extending obliquely to the axis of the spindle 8, and oblique top and bottom faces 39 extending generally at right angles to the faces 38 and which have a greater inclination than the faces 38.

In the case of forward directed force acting on the sole holder elements 9 and 10, forward rotation of such elements causes the projection 19 to slide over the bottom oblique face 39 so that the sole holder elements are free to pivot forward when a preset force is exceeded. Due to the different angles of the oblique faces 38 and 39, it is possible to have different frontal and lateral tripping forces required to release the sole holder elements.

I claim:

1. In a safety ski binding for releasably holding a ski boot on a ski, a front binding comprising in combination:

a securing member;

means for mounting said securing member on the ski for movement generally parallel to the upper surface of the ski in a direction transversely of the longitudinal direction of the ski;

a spindle carried by said securing member for movement therewith and extending transversely of the longitudinal direction of the ski, generally parallel to the upper surface of the ski and below the plane of the ski boot sole;

a sleeve mounted on said spindle for movement therewith, said sleeve having a groove in its outer periphery which groove extends transversely to the longitudinal direction of the ski and generally parallel to the upper surface of the ski;

at least one sole holder element carried by said sleeve and having stops normally engaged against the ski boot to deter movement of the ski boot longitudinally and laterally of the ski, said sole holder element being forwardly swingable about the axis of said spindle into a position below the plane of the ski boot sole so as to permit unimpeded movement of the ski boot relative to said sole holder element; and means for normally holding said sole holder element in its position deterring movement of the ski boot but releasable when a force in excess of a predetermined force is exerted against said sole holder element, said holding means including a projection normally engaged in said groove of said sleeve but displaceable therefrom by movement of said sleeve transversely to the longitudinal direction of the ski so as to permit rotation of said sleeve and forward swinging of said sole holder element.

2. In the ski binding defined in claim 1, the mounting means for the securing member including transversely spaced levers extending parallel to the longitudinal direction of the ski, said levers having forward end portions connected to the securing member and rear end portions connected to the ski to permit movement of the securing member transversely of the ski by swinging of said levers.

3. In the ski binding defined in claim 1, the mounting means for the securing member including transversely spaced leaf springs extending generally parallel to the longitudinal direction of the ski, said leaf springs having corresponding ends connected to the securing member, the other ends of said leaf springs being connected to the ski to permit movement of the securing member by flexing of said springs.

4. In the ski binding defined in claim 1, stop means for limiting transverse movement of the securing member relative to the ski.

5. In the ski binding defined in claim 1, means mounting the projection for movement in the longitudinal direction of the ski, and a spring biasing the projection toward the sleeve.

6. In the ski binding defined in claim 5, the securing member having sliding faces at opposite sides of the sleeve groove, respectively, and extending obliquely to the longitudinal direction of the ski, the projection having a tip portion normally received in the sleeve groove and opposite side portions engageable against said sliding faces of the securing member by movement of the securing member in a direction transversely to the longitudinal direction of the ski so as to force said projection tip portion from the sleeve groove in opposition to the force of the spring.

7. In the ski binding defined in claim 5, the sleeve having oblique surfaces at opposite sides of the sleeve groove such that movement of the sleeve relative to the projection wedges the projection from the sleeve groove.

8. In the ski binding defined in claim 1, means for automatically swinging the sole holder element rearward from its position below the plane of the ski boot sole.

9. In the ski binding defined in claim 1, a sole tread plate interposed between the ski boot sole and the upper surface of the ski.

10. In the ski binding defined in claim 9, means for mounting the sole tread plate for movement in a plane parallel to the upper surface of the ski.

11. In the ski binding defined in claim 10, the mounting means for the sole tread plate including a plurality of rollers interposed between the sole tread plate and the upper surface of the ski to assist in movement of the sole tread plate relative to the ski.

12. In the ski binding defined in claim 10, the mounting means for the sole tread plate including a pivot extending perpendicular to the upper surface of the ski and mounting the sole tread plate for swinging about the axis of said pivot.

13. In the ski binding defined in claim 12, the sole tread plate extending substantially the full length of the ski boot and the pivot being located beneath the heel portion of the ski boot.

* * * * *